United States Patent [19]

Bennett et al.

[11] 4,133,067

[45] Jan. 9, 1979

[54] ARTICULATING GANGWAY

[76] Inventors: Ronald W. Bennett; Herbert H. Williams, both of P.O. Box 5329, Florence, S.C. 29501

[21] Appl. No.: 861,557

[22] Filed: Dec. 16, 1977

[51] Int. Cl.[2] ..... E01D 1/00

[52] U.S. Cl. ..... 14/71.3; 405/220; 214/14

[58] Field of Search ..... 14/69.5, 71.1, 71.3, 14/47; 61/48, 49; 214/14

[56] References Cited

U.S. PATENT DOCUMENTS

| | | | |
|---|---|---|---|
| 233,159 | 10/1880 | Mooney | 14/69.5 |
| 555,542 | 3/1896 | Throop | 14/69.5 |
| 1,682,208 | 8/1928 | Barlow | 14/69.5 |
| 2,372,574 | 3/1945 | Haynes | 14/71.1 |
| 2,617,131 | 11/1952 | Harris | 14/71.1 |
| 2,641,785 | 6/1953 | Pitts | 14/71.1 |
| 3,426,719 | 2/1969 | Mizell | 14/71.1 X |
| 3,747,354 | 7/1973 | Macomber | 14/69.5 X |
| 3,879,784 | 4/1975 | Kummerman | 14/71.1 |
| 4,003,473 | 1/1977 | Ryan | 14/71.1 X |
| 4,035,861 | 7/1977 | Edge | 14/71.1 |

*Primary Examiner*—Nile C. Byers, Jr.
*Attorney, Agent, or Firm*—Clarence A. O'Brien; Harvey B. Jacobson

[57] ABSTRACT

An articulating gangway having an elongated member forming a passageway and pivotally mounted on a supporting base for vertical swinging movement about a substantially horizontal axis and slewing movement about a vertical axis. A position control assembly is connected to the gangway for controlling the swinging movement of the member, with this control assembly having a slack take-up arrangement included therein for keeping a cable connected between a free end of the member and a suitable winch taut at all times in order to permit position changes of the gangway member, such as due to the change in tides, without actuation of the winch once the gangway member is lowered into an operative position. A gangway element can be pivotally attached to the outer end of the gangway member for permitting the terminal end of the passageway formed by the gangway to be in abutting relationship to the deck of a ship, and the like, with which the gangway is deployed regardless of the relative position of the base of the gangway to the ship. Wheels or rollers are advantageously provided on the outer portion of the gangway in order to permit the gangway to better meet changing deck conditions and pitch, while a stop can be disposed in the joint between the gangway member and the gangway element for permitting only downward swinging movement of the gangway element relative to the gangway member.

8 Claims, 11 Drawing Figures

ARTICULATING GANGWAY

BACKGROUND OF THE INVENTION

1. Field of the Invention

This invention relates generally to a walkway, and particularly to an articulating marine walkway, or gangway, designed to be stored in elevated position and capable of being properly positioned by one man so as to allow for variance in the position of a vessel vertically and horizontally within prescribed limits with respect to a fixed point of mounting of the gangway, all the while providing for safe access between a vessel and an adjacent dock or pier.

2. Description of the Prior Art

U.S. Pat. No. 3,879,784, issued Apr. 29, 1975, to H. Kummerman, discloses a slewing access ramp for vehicles wherein a ramp is pivotally connected to a ship or other form of transport so that the ramp can be swung upwardly and downwardly and also side-to-side. In particular, the ramp disclosed in U.S. Pat. No. 3,879,784 employs a pair of king posts having pulleys thereon about which passes a cable extending to the outer end of an inner ramp portion, to which inner ramp portion is pivotally connected an outer ramp portion or section. Further, U.S. Pat. No. 3,953,980, issued May 4, 1976, to G. B. Bennett, discloses in FIG. 7 thereof a dock structure similar to a ramp or gangway and which is swingable from side-to-side by selectively releasing one of a pair of collars.

Additional examples of articulated walkways can be found in U.S. Pat. Nos. 785,400, issued Mar. 21, 1905, to J. D. Buchanan; 1,232,437, issued July 3, 1917, to L. Simpson; and 3,747,354, issued July 24, 1973, to R. M. Macomber. In addition, U.S. Pat. No. 1,674,279, issued June 19, 1928, to P. Ebeling, discloses a foldable or collapsible crossing bridge which may be readily set up and removed, while U.S. Pat. Nos. 2,607,937, issued Aug. 26, 1952, to G. B. Stone, and 3,228,051, issued Jan. 11, 1966, to T. R. Voase, et al., disclose adjustable ramps or walkways wherein the height of one end of the ramp is adjustable by the use of a hand-actuated winch, and the like. In particular, U.S. Pat. No. 3,228,051 discloses the use of a wheel on the movable end of the ramp in order to faciliate displacement of the associated end of the ramp with respect to a moving object, such as a ship, on which the wheel is resting.

SUMMARY OF THE INVENTION

It is an object of the present invention to provide a marine walkway which compensates for variances in vessel location both vertically and horizontally automatically without the need of manual corrections.

It is another object of the present invention to provide a walkway which, once installed, can be operated without the need of tools, the ramp being merely lowered by means of a winch.

Yet another object of the present invention is to provide a marine walkway which, when resting on a vessel, is not dependent on cables for support, the cables being used only for raising and lowering and storing the gangway in an upright position.

It is yet another object of the present invention to provide a marine walkway, or gangway, which includes cables fitted with a sliding weight and pulley arrangement which take up slack in the cable.

These and other objects are achieved according to the present invention by providing a walkway having:

an elongated member forming a passageway; a base connected to the elongated member for pivotally supporting the elongated member for movement about a substantially horizontal axis and permitting the member to swing in a substantially vertical path; and a position control system connected to the elongated member for controlling swinging movement of the member.

The base of the walkway preferably includes a pivot support forming the horizontal pivot axis of the elongated member, with the pivot support itself being mounted for pivotal movement about a substantially vertical axis for slewing the elongated member. The base also advantageously includes a tower arranged extending upwardly from adjacent the pivot support for supporting in part the position control system. The elongated member itself extends longitudinally and has a pair of spaced ends, with one of the ends being pivotally attached to the support means of the base, and the position control system being connected to the other of the ends of the member for selectively pulling the member in a vertical path toward a substantially vertical storage position.

The position control system preferably includes a weight supported on the tower of the base by a cable connected at longitudinally spaced ends thereof to the free end of the elongated member and to the winch, with the weight being supported by the cable between the member and winch. The purpose of the weight is to take up slack in the cable with a force substantially less than the mass of the elongated member, with the winch being arranged for swinging the member upwardly against the mass thereof and holding the member in the aforementioned stored position.

The walkway further includes an element pivotally attached to the other of the ends of the elongated member for pivotal movement about an axis spaced from but substantially parallel to the pivot axis of the member relative to the pivot support of the base. This element is arrangeable abutting a support with which the walkway engages when in an operative position. In particular, it is contemplated that this support will be the deck of a ship subject to movement by tides, waves, wind, and the like, in which case the pivotally mounted element permits the walkway to remain in engagement with the deck of the ship regardless of its height or pitch, with the slack take-up feature of the position control system of the walkway permitting the walkway to move up and down as necessary without use of the winch.

A stop can be provided on one of the walkway member and element for limiting pivotal movement of the element relative to the member to a downward swing only, while wheels or rollers are advantageously provided on the walkway for facilitating adjustment of the walkway relative to a changed position of the support. That is, the support may move toward and away from the base of the walkway, thus making the rolling friction afforded by wheels or rollers of great benefit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
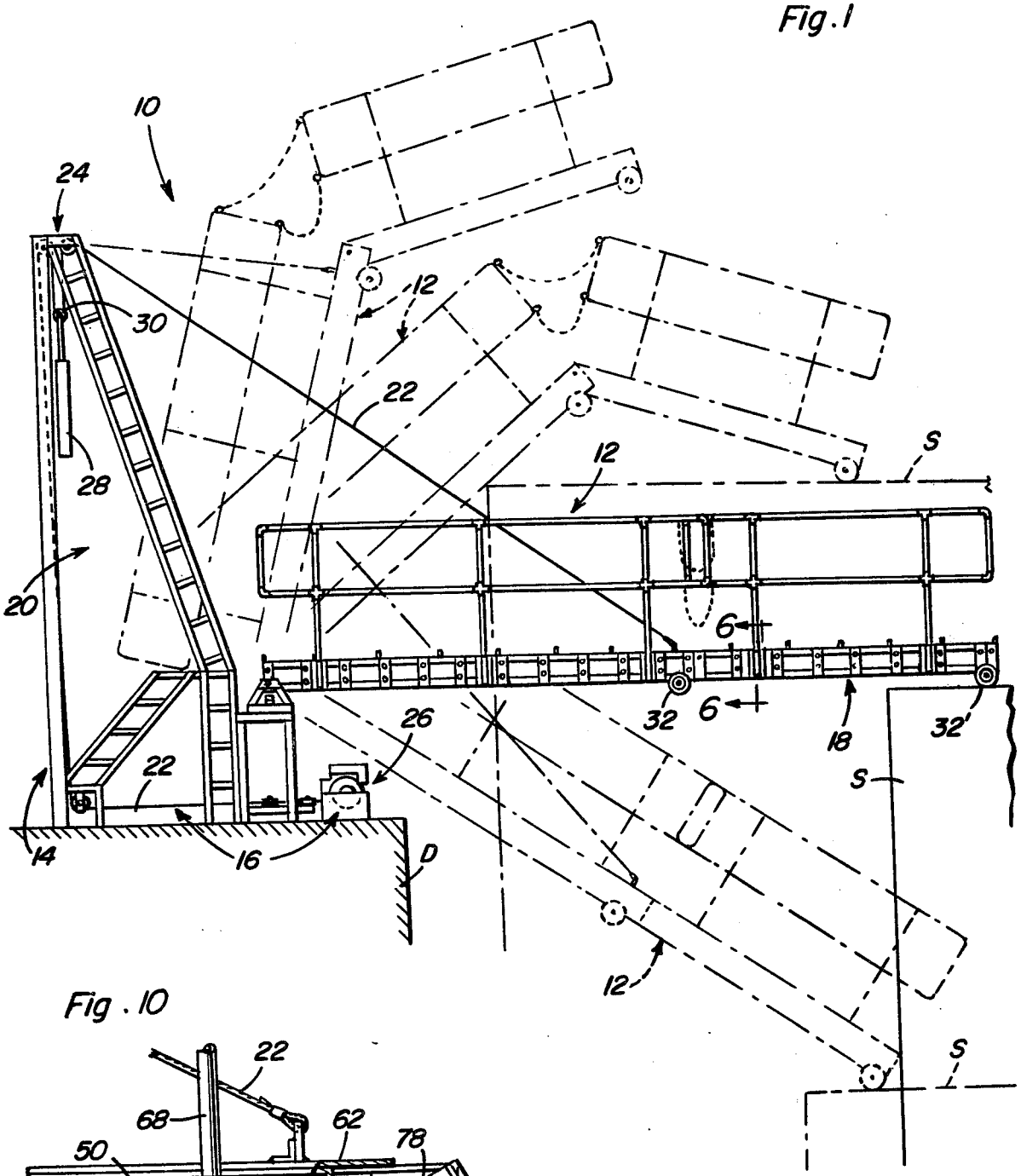
FIG. 1 is a schematic, side elevational view showing the basic layout of a walkway according to the invention, and several of the numerous positions the walkway can assume.
Figure 2:
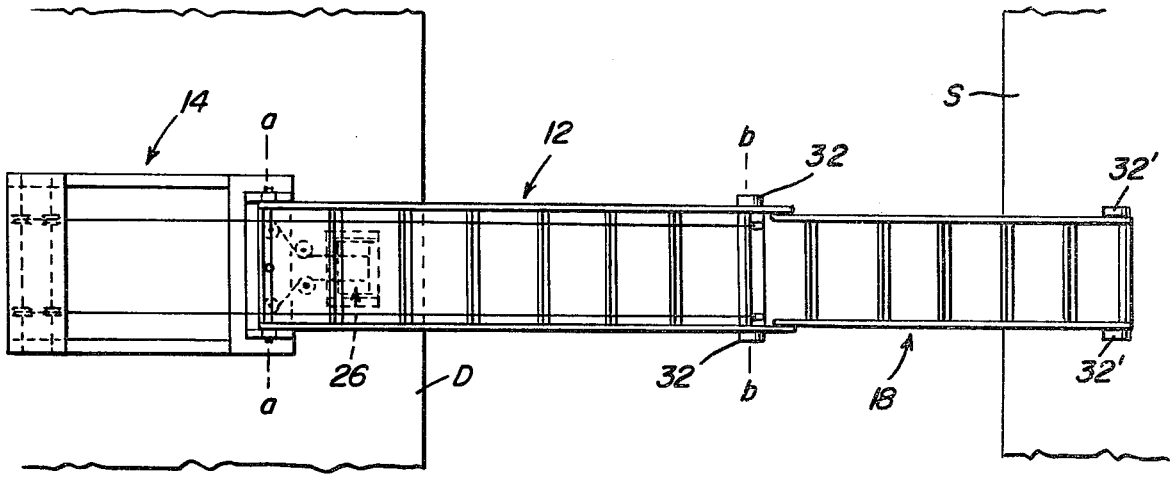
FIG. 2 is a top plan view of the structure as seen in FIG. 1.
Figure 6:
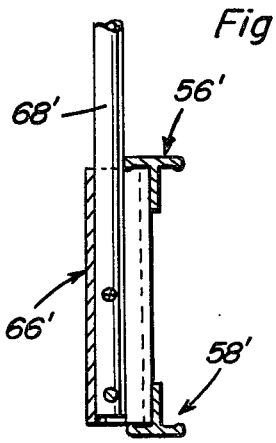
FIG. 6 is an enlarged, fragmentary, sectional view taken generally along the line 6—6 of FIG. 5.

Referring now more particularly to FIGS. 1 and 2 of the drawings, a walkway 10 according to the present invention includes an elongated member 12 forming a passageway and pivotally supported by a base 14 in such a manner that member 12 can pivot about a substantially horizontal axis a—a and is permitted to swing in a substantially vertical path. A position control system 16 is connected to the member 12 for controlling swinging movement of walkway 10, while member 12 pivotally attached to the outer end thereof, that being the end spaced from axis a—a, an element 18 arranged for pivotal movement about an axis b—b disposed substantially parallel to axis a—a. This element 18 is arranged for abutting a support S, such as the deck of a ship. Base 14 includes a tower 20 arranged extending upwardly for supporting in part the position control system 16, which system 16 permits the member 12, and accordingly element 18, to adjust to various heights and distances of support S relative to a dock D, and the like, on which walkways 10 is mounted, as indicated by the broken line showings of member 12 in FIG. 1.

Position control system 16 includes a cable 22 arranged extending over a pulley assembly 24 and between a conventional winch 26 and the outer end of member 12. A suitable weight 28 provided with a conventional sheave 30 so as to be suspended from cable 22 between a pair of conventional pulleys forming pulley assembly 24. By this arrangement, it can be appreciated that the downward pull of weight 28 will assure cable 22 remaining in a taut condition regardless of the position of member 12, and cable 22 will be retained in this taut condition without actuation of winch 26. Thus, winch 26 need only be employed to raise member 12 upwardly into a storage position (not shown) and to lower member 12 downwardly into an operative position, as desired. Once lowered into operative position, member 12, and accordingly element 18, can move together with the support S with cable 22 remaining taut without additional use of winch 26. Member 12 is supported by support S once member 12 is lowered into the operative position thereof.

Rollers or wheels 32, 32' are provided on the walkway, preferably as illustrated on member 12 adjacent the outer end thereof and at the terminal end of element 18, with these wheels 32, 32' being arranged for engaging support S and permitting adjustment of member 12 and element 18 relative to a changed position of support S, as can be appreciated by the several positions of the walkway seen in FIG. 1.

Figure 3:
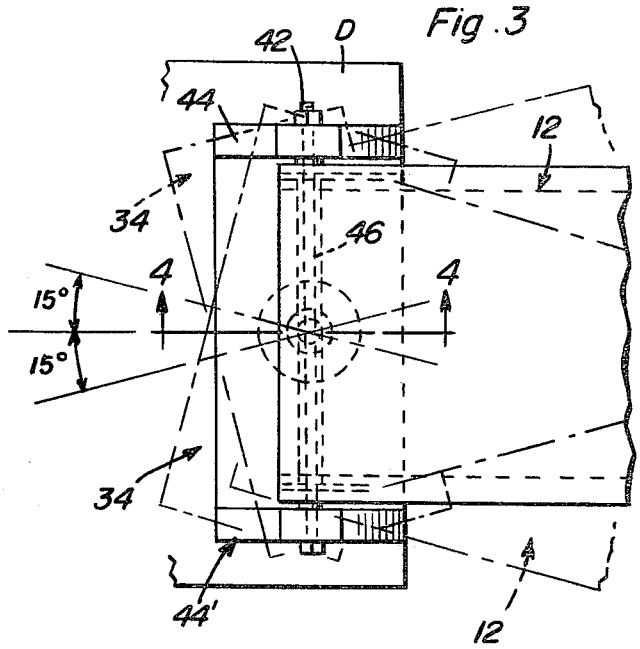
FIG. 3 is an enlarged, fragmentary, schematic, top plan view showing the pivotal mounting of the walkway inner member on a base of the walkway.
Figure 4:
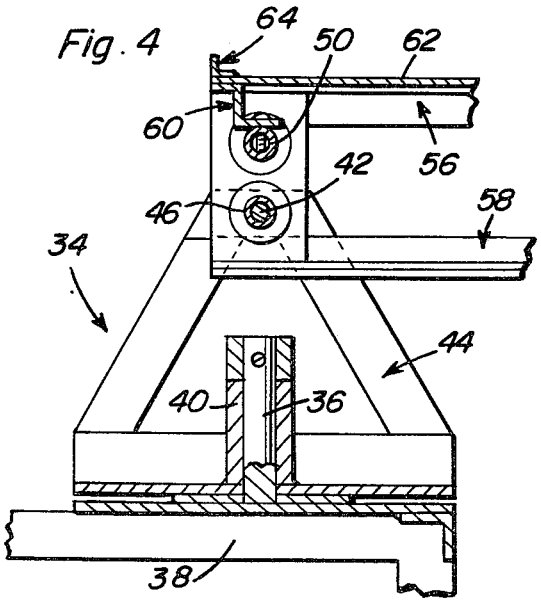
FIG. 4 is a fragmentary, sectional view taken generally along the line 4—4 of FIG. 3.

Referring now more particularly to FIGS. 3 and 4 of the drawings in addition to FIGS. 1 and 2, base 14 includes a pivot support 34 forming the horizontal pivot axis a—a for member 12 and itself mounted for pivotal movement about a substantially vertical axis for slewing the member 12. More specifically, pivot support 34 is journaled on a shaft 36 extending vertically from a platform 38 partially forming base 14 and received in a sleeve 40 affixed to pivot support 34. Axis a—a itself is formed as by a rod 42 journaled in trusses 44, 44' of pivot support 34 and rotatably journaled in a sleeve 46 affixed to the adjacent end of member 12.

As can be seen from FIGS. 5 through 11 of the drawings, in conjunction with FIGS. 1 through 4, member 12 and element 18 are provided with suitable handrails 48 and 48', respectively. Each of member 12 and element 18 themselves is contructed in a similar manner by side rails separated by a plurality of substantially parallel, longitudinally spaced upper and lower sleeves 50 and 50' retained as by suitable friction clamps 50, 52' to side plates 54, 54' and mounted on upper and lower I-beams 56, 56' and 58, 58' which form the side rails. Z-bars 60 are used to connect flooring 62 to the upper sleeves 50, while angle cleats 64 are spaced along the upper surface of flooring 62 along the longitudinal extent of member 12 and element 18. Handrails 48 and 48' are supported on the side rails of member 12 and element 18, respectively, by stanchions 66, 66' which receive posts 68 and 68'.

Adjacent ends of handrails 48 and 48' are provided with legs 70 and 70' extending substantially perpendicularly to the plane of the associated member 12, 18, and connected to the rest of the associated handrail structure by upper rails 72, 72' and lower rails 74 and 74' substantially parallel to the upper rails. Suitable safety chains 76 and 76' are advantageously mounted on legs 70, 70', by means of suitable fittings, in order to help limit the downward swing of element 18 with respect to member 12.

Figure 10:
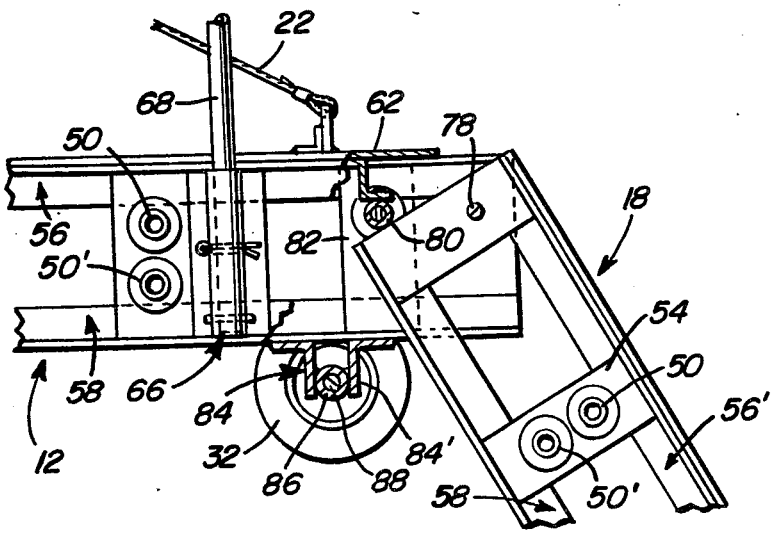
FIG. 10 is an enlarged, fragmentary, side elevational view, partly broken away and in section, showing in detail the lower right center portion of FIG. 5, but with the outer walkway element in a changed position.
Figure 9:
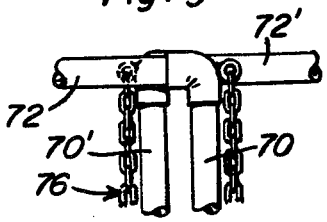
FIG. 9 is an elongated, fragmentary, side elevational view showing in detail the upper right center portion of FIG. 5.

Element 18 is pivotally mounted on member 12 as by a threaded rod 78 secured to the outer end of member 12 and received in the opposed side rails of element 18. As can be seen from FIG. 10, a sleeve 80 extending between side plates 82 at the outer end of member 12 helps form a stop in the downward direction for element 18 relative to member 12. This sleeve 80 is similar to the upper sleeves 50 otherwise disposed throughout the length of member 12. As can be appreciated, the mounting of element 18 on member 12 as seen in FIG. 10 will result in element 18 being stopped from upward movement relative to member 12 so as to achieve the straight relationship of the member 12 and element 18 as seen in full lines in FIG. 1, due to the flush engagement of flooring 62, 62' and the upper I-beams 56, 56'.

Figure 11:
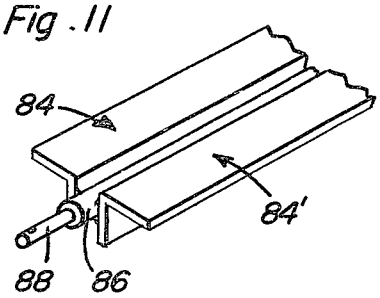
FIG. 11 is a fragmentary, perspective view showing the axle mounting for the wheels of the ramp portion of the walkway.
Figure 5:
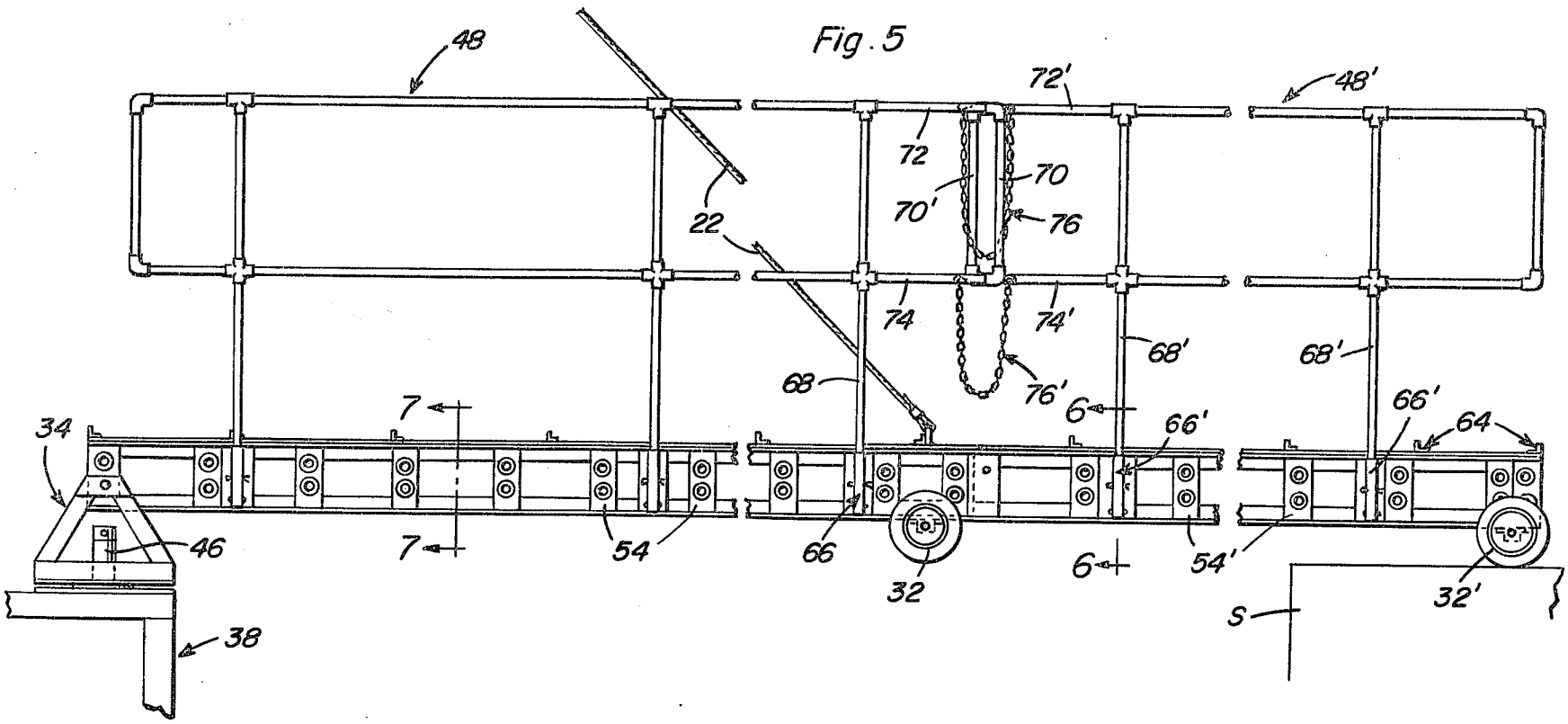
FIG. 5 is an enlarged, fragmentary, side elevational view showing the ramp portion of the structure of FIG. 1 in greater detail.
Figure 8:
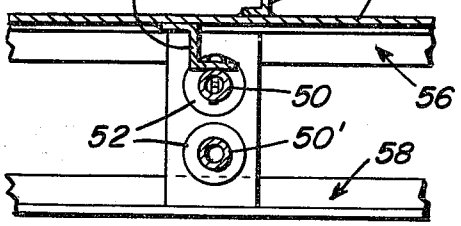
FIG. 8 is an enlarged, fragmentary, sectional view taken generally along the line 8—8 of FIG. 7.
Figure 7:
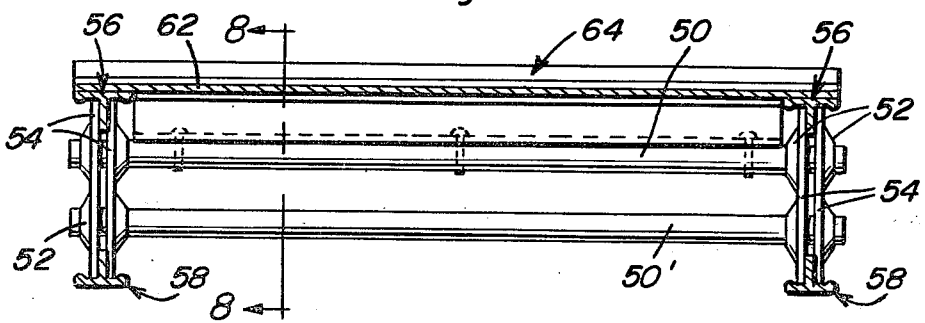
FIG. 7 is an enlarged, sectional view taken generally along the line 7—7 of FIG. 5, but with some parts removed.

Wheels 32, 32' are advantageously mounted on the underside of the members 12, 18 as by an arrangement best seen in FIG. 11 and including a pair of spaced, substantially parallel, coextensive angle beams 84 and 84' having affixed between same a sleeve 86 which journals a shaft 88 on which wheels 32, 32' may be mounted in a suitable manner.

As can be readily understood from the above description and from the drawings, a walkway according to the present invention will, once lowered into operative position, automatically correct to variances in the location of support S both vertically and horizontally without the need of manual corrections. When the ramp formed by member 12 and element 18 is resting on support S, the ramp is not dependent on cables 22 fo support. The cables 22 are used only for raising and lowering and storing the ramp in the upright position (not shown).

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is as follows:

1. A walkway, comprising, in combination:

(a) an elongated member forming a passageway;

(b) base means connected to the elongated member for pivotally supporting the elongated member for movement about a substantially horizontal axis and permitting the member to swing in a substantially vertical path; and (c) position control means connected to the member for controlling swinging movement of the member, the position control means including, in combination:

(3) weight;

(4) a winch; and (5) cable means connected to the elongated member and to the winch and arranged supporting the weight between the member and winch, the weight taking-up slack in the cable means during an upward movement of the member about the horizontal pivot axis thereof, while being selected to have less weight than the member and permitting the cable means to be let-out during a downward movement of the member about the horizontal pivot axis thereof, with the winch being arranged for swinging the member upwardly against the mass of the member in order to move the member toward the substantially vertical storage position thereof.

2. A structure as defined in claim 1, wherein the base means includes, in combination:

(1) a pivot support means forming the horizontal pivot axis for the elongated member and mounted for pivotal movement about the substantially vertical axis for slewing the elongated member; and (2) tower means extending upwardly from adjacent the pivot support means for supporting in part the cable means of the position control means.

3. A structure as defined in claim 2, wherein the member extends longitudinally and has a pair of spaced ends, with one of the ends being pivotally attached to the base means, and the pivot control means being connected to the other of the ends of the member for selectively forcing the member toward a substantially vertical storage position.

4. A structure as defined in claim 3, wherein the walkway further includes an element pivotally attached to the other of the ends of the longitudinally extending member for pivotal movement about an axis substantially parallel to the pivot axis of the member, the element arranged for abutting the support regardless of variations in position of the support relative to the walkway.

5. A structure as defined in claim 4, wherein stop means is provided on the member and element for limiting pivotal movement of the element relative to the member to a downward swing only.

6. A structure as defined in claim 5, wherein wheels are provided on the member and element, which wheels are arranged for engaging the support and facilitating adjustment of the element relative to a changed position of the support.

7. A method for controlling the position of a longitudinally extending member having longitudinally spaced ends and pivoted at one of the ends for swinging movement about a horizontal axis, comprising the steps of:

(a) attaching one end of a length of cable to the member at a point on the member spaced from the horizontal axis, and to a winch; and (b) biasing the cable intermediate of the member and winch for retaining the cable taut regardless of the position of the member about the horizontal axis, while simultaneously permitting the member to pull cable against the bias.

8. A method as set forth in claim 7, wherein the step of biasing the cable includes the step of suspending a mass from the cable between the member and the winch.

* * * * *